US008469140B1

(12) United States Patent
Graber

(10) Patent No.: US 8,469,140 B1
(45) Date of Patent: Jun. 25, 2013

(54) RADIAL WAVEGUIDE FOR DOUBLE CONE TRANSDUCERS

(76) Inventor: Curtis E. Graber, Woodburn, IN (US)

( * ) Notice: Subject to any disclaimer, the term of this patent is extended or adjusted under 35 U.S.C. 154(b) by 0 days.

(21) Appl. No.: 13/346,077

(22) Filed: Jan. 9, 2012

(51) Int. Cl.
*G10K 11/02* (2006.01)

(52) U.S. Cl.
USPC ..... 181/192; 181/144; 181/177; 381/343

(58) Field of Classification Search
USPC ..... 181/144, 152, 155, 156, 177, 179, 181/185, 189, 192, 194, 196; 381/337, 338, 381/339, 340, 341, 342, 343, 352
See application file for complete search history.

(56) References Cited

U.S. PATENT DOCUMENTS

| | | | | | |
|---|---|---|---|---|---|
| 1,568,589 | A | * | 1/1926 | Eddington | 381/418 |
| 3,477,540 | A | * | 11/1969 | Rizo-Patron | 381/89 |
| 4,014,597 | A | * | 3/1977 | Griffin, Jr. | 312/7.1 |
| 4,016,953 | A | * | 4/1977 | Butler | 381/89 |
| 4,796,009 | A | | 1/1989 | Biersach | |
| 5,146,508 | A | | 9/1992 | Bader et al. | |
| 5,253,301 | A | * | 10/1993 | Sakamoto et al. | 381/89 |
| 5,255,321 | A | * | 10/1993 | Murray et al. | 381/71.7 |
| 5,321,388 | A | * | 6/1994 | Biersach | 340/404.1 |
| 5,359,158 | A | * | 10/1994 | Queen | 181/150 |
| 5,637,840 | A | * | 6/1997 | Kim | 181/152 |
| 5,701,358 | A | | 12/1997 | Larsen et al. | |
| 5,749,433 | A | * | 5/1998 | Jackson | 181/156 |
| 5,804,774 | A | * | 9/1998 | Ford et al. | 181/152 |
| 6,094,495 | A | * | 7/2000 | Rocha | 381/340 |
| 7,021,419 | B2 | * | 4/2006 | Sadaie et al. | 181/156 |
| 7,360,499 | B1 | | 4/2008 | O'Neill | |
| 7,621,369 | B2 | * | 11/2009 | Graber | 181/191 |
| 7,837,006 | B1 | | 11/2010 | Graber | |
| 2009/0147980 | A1 | * | 6/2009 | Fincham | 381/352 |
| 2011/0051970 | A1 | * | 3/2011 | Jenkins | 381/346 |

* cited by examiner

*Primary Examiner* — Jeremy Luks
(74) *Attorney, Agent, or Firm* — Paul W. O'Malley; Susan L. Firestone

(57) ABSTRACT

A radial waveguide assembly comprises a transducer section and a waveguide section. The transducer section includes first and second cone loudspeakers arranged coaxially and in an opposed relationship. A compression plug having two input surfaces is mounted between diaphragms of the cone loudspeakers. Channels from the first and second cone loudspeakers feed common sound chambers located in a belt around the circular perimeter where they connect to external ports. A radial; folded waveguide has a circular throat which connects to the external ports.

3 Claims, 19 Drawing Sheets

RADIAL WAVEGUIDE FOR DOUBLE CONE TRANSDUCERS

BACKGROUND

1. Technical Field

The field relates to sound reproduction and more particularly waveguides for collecting and directing sound from multiple sources at high intensities.

2. Description of the Problem

In U.S. Pat. No. 7,837,006 Graber described a sound field blending and projection system which combined inputs from a plurality of loudspeakers arranged in a circular or radial array. The loudspeakers were horn loaded with the effective mouths of the horns being differentially located for different frequencies. The horn mouth at lower frequencies was a blended mouth for what was in effect a multi-throated horn which exhibited a fold for low frequencies. Higher frequencies were directed inwardly against a spike or cone like reflector located at the center of the circle. The reflector was oriented to merge the higher frequency sound waves in a beam and to reflect the beam along a radiant axis at a right angle to the plane of the circle. For lower frequency sound the central spike or cone was largely ineffective with low frequency sound directed along the same radiant axis as for the higher frequencies by the blended horn mouth and horn fold.

Compression plugs are well known devices for increasing transducer efficiency and numerous references relate to their use with single transducers coupled with a horn.

SUMMARY

A radial waveguide assembly comprises a transducer section and a waveguide section. The transducer section includes first and second cone loudspeakers arranged coaxially and in opposed directions with the diaphragms pointed in toward one another. A compression plug having two input surfaces is mounted between diaphragms of the cone loudspeakers. The input surfaces are located along opposite ends of the compression plug. The input surfaces conform in shape with the diaphragms of the cone loudspeakers and are located juxtaposed the diaphragms. Channels through compression plug run from the input surfaces to outlets on a circular perimeter of the compression plug. Channels from the first and second cone loudspeakers feed common sound chambers located in a belt around the circular perimeter where they connect to external ports. A radial, folded waveguide has a circular throat which connects to the external ports. The radial, folded waveguide comprises inner and outer sections. The outer section or form is generally bowl or cup like with vertical outer sides. The transducer section is mounted at the bottom center of the bowl. The inner section of the waveguide is located inside the bowl and houses a portion of the transducer assembly. The contour of the inner section is selected to determine the rate of expansion of the waveguide if used as a horn.

BRIEF DESCRIPTION OF THE DRAWINGS

Understanding of the following description may be enhanced by reference to the accompanying drawings wherein.

DETAILED DESCRIPTION

Figure 1:
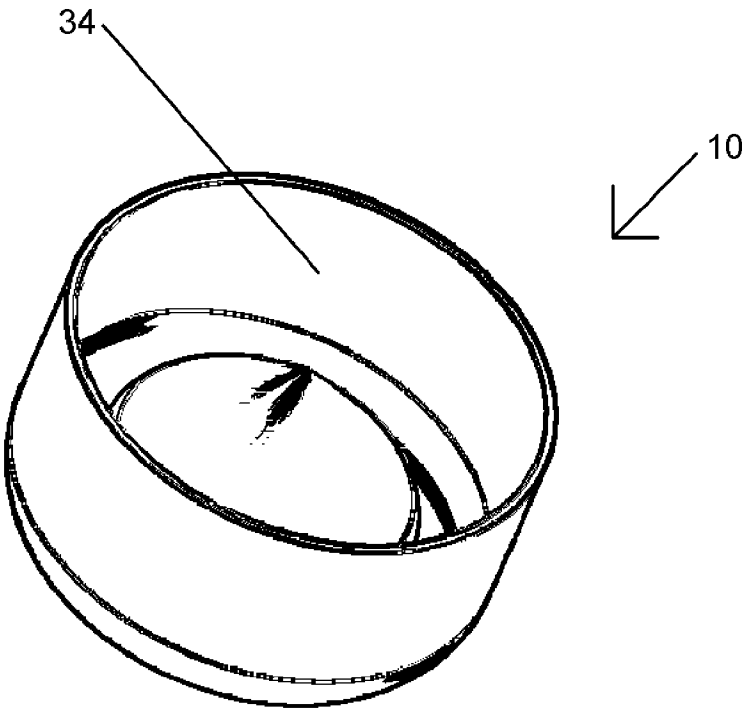
FIG. 1 is a perspective view of a radial waveguide assembly.
Figure 2A:
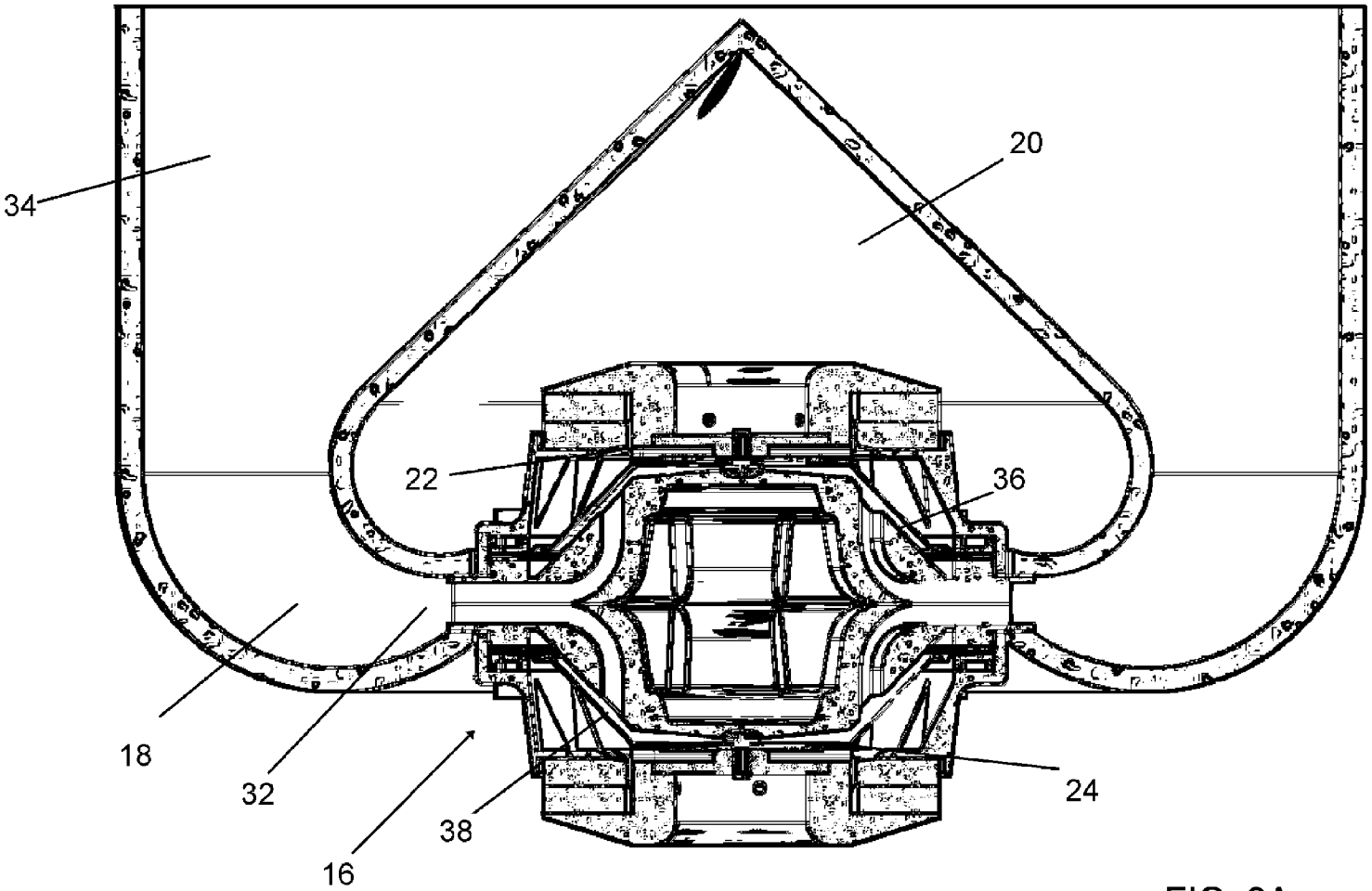
FIG. 2A is a cross sectional view of the radial waveguide assembly of FIG. 1.
Figure 2B:
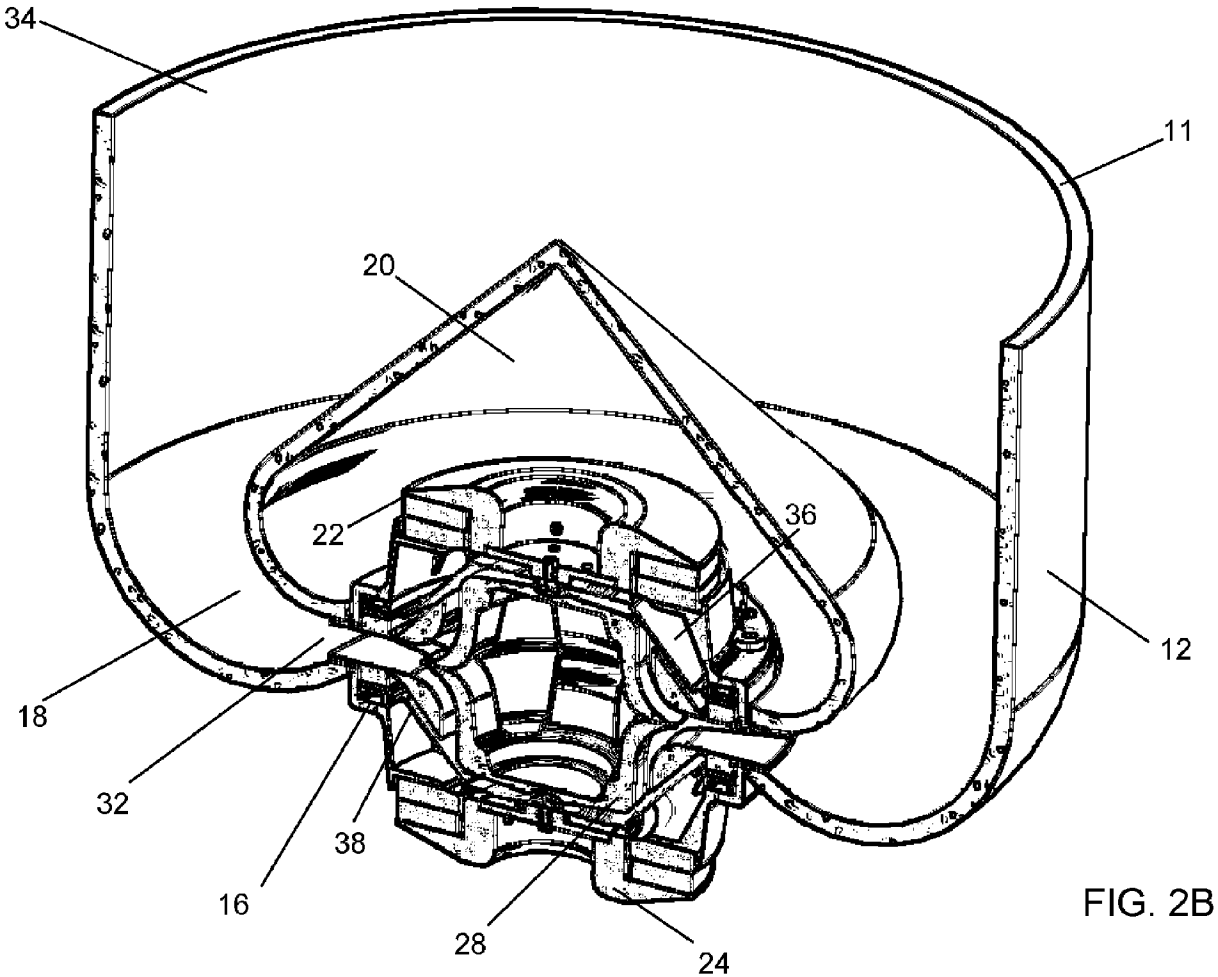
FIG. 2B is a cross sectional view of the radial waveguide assembly of FIG. 1.
Figure 3A:
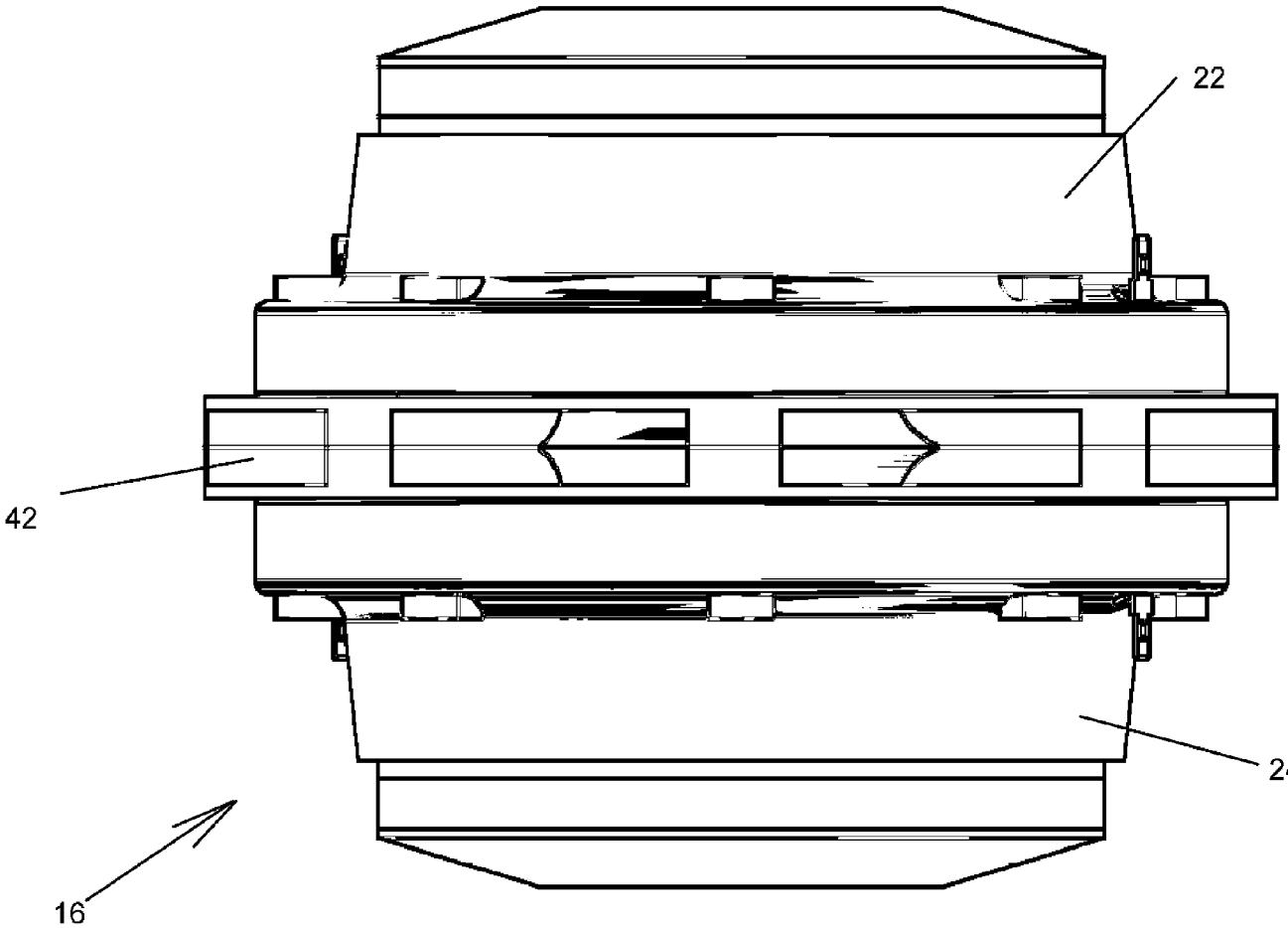
FIG. 3A is a side elevation of the transducer assembly of the radial waveguide assembly of FIG. 1.
Figure 3B:
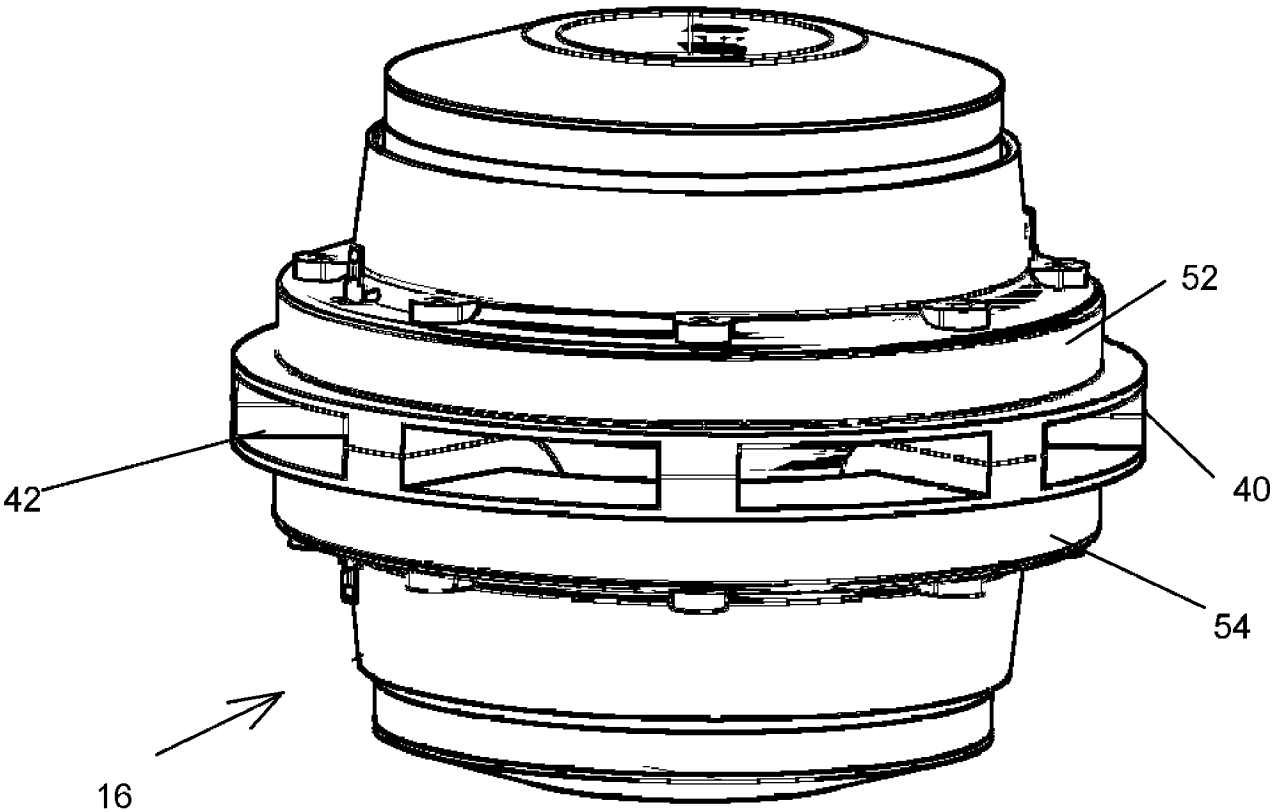
FIG. 3B is a perspective view of the transducer assembly for the radial waveguide of FIG. 1.
Figure 3C:
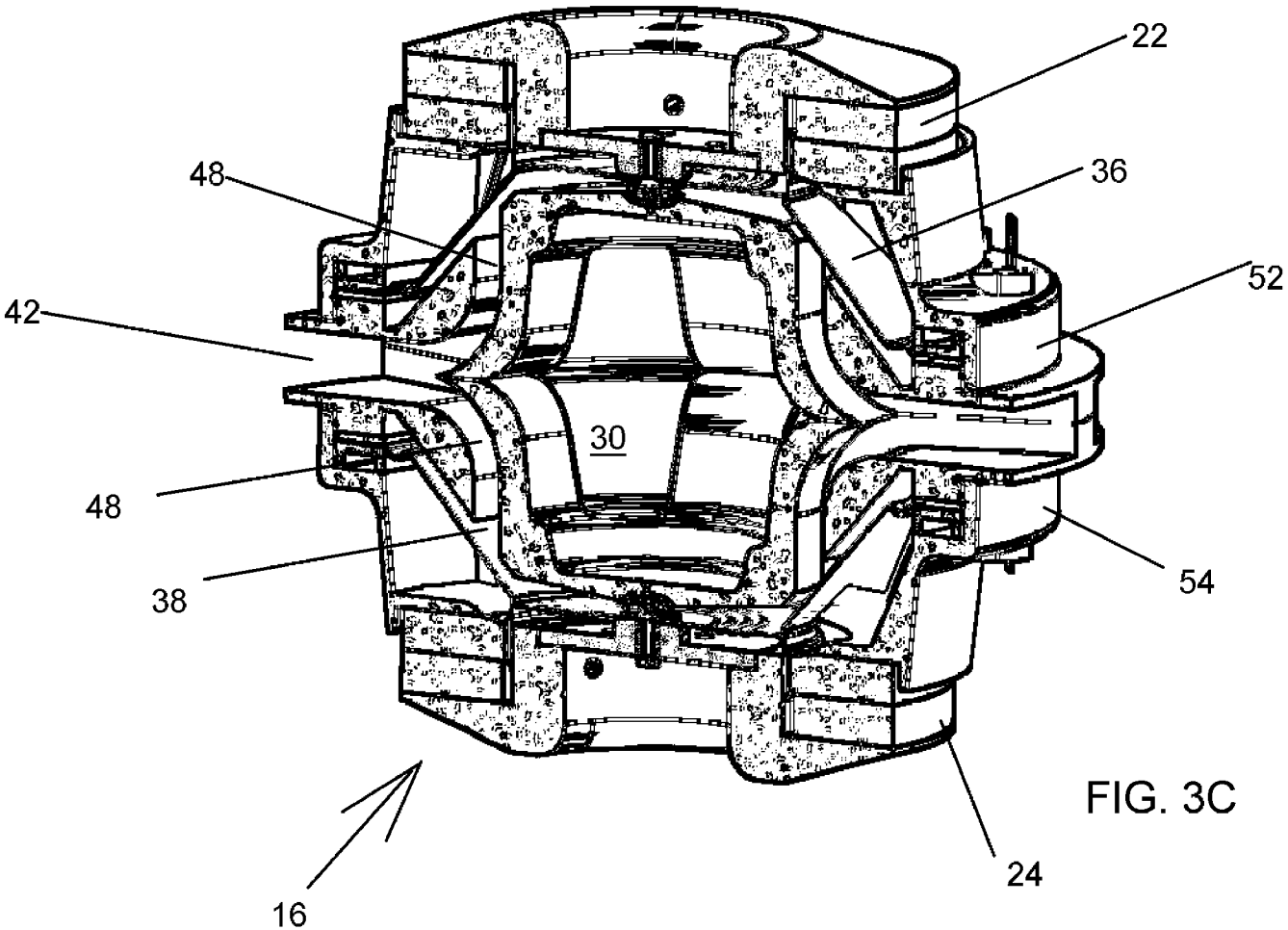
FIG. 3C is a cross sectional view of the transducer assembly of FIG. 3A.
Figure 4A:
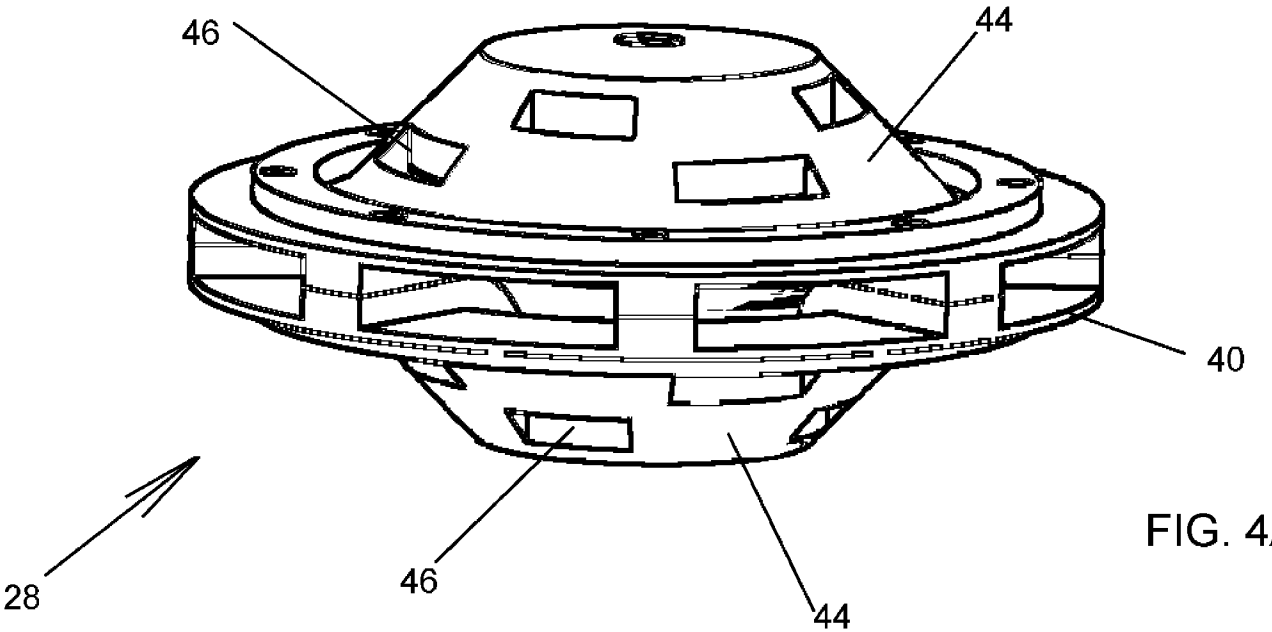
FIG. 4A is a perspective view of a compression plug from the transducer assembly of FIG. 3A.
Figure 4B:
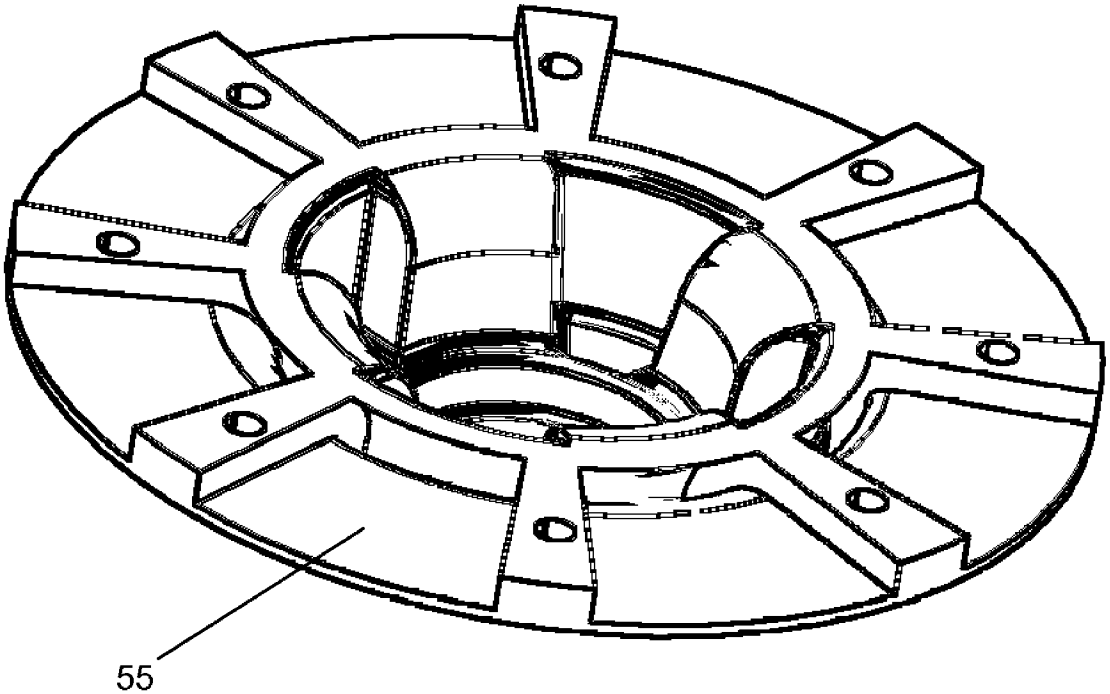
FIG. 4B is a perspective view of a compression plug section molding.
Figure 4C:
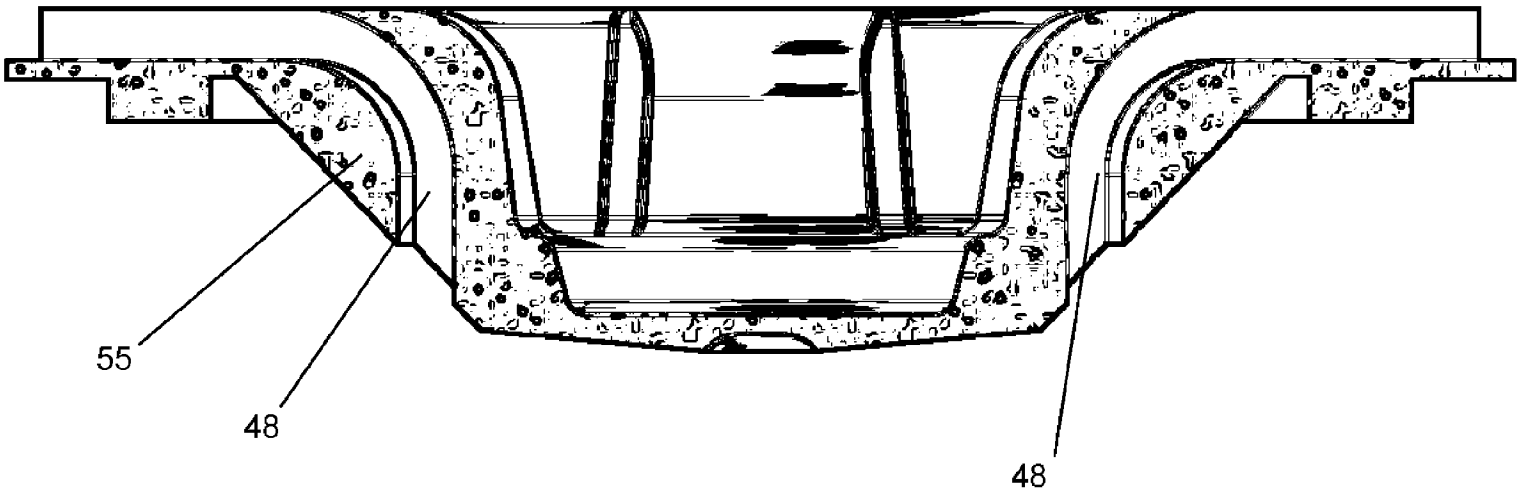
FIG. 4C is a cross sectional view of a compression plug section molding.
Figure 4D:
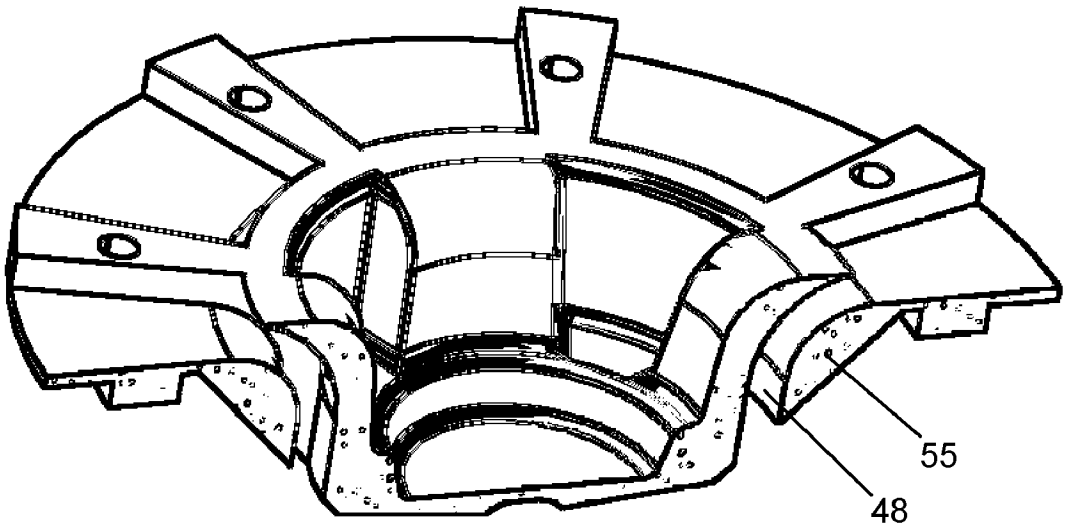
FIG. 4D is a cutaway perspective view of a compression plug section molding.
Figure 4E:
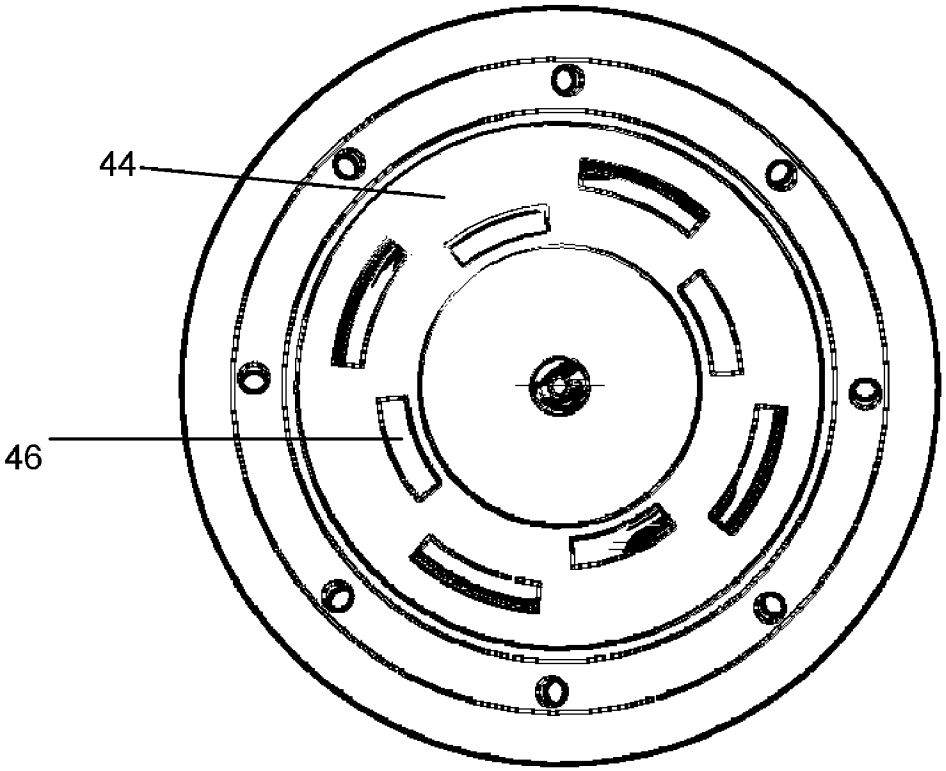
FIG. 4E is a top plan view of a compression plug section molding.
Figure 5A:
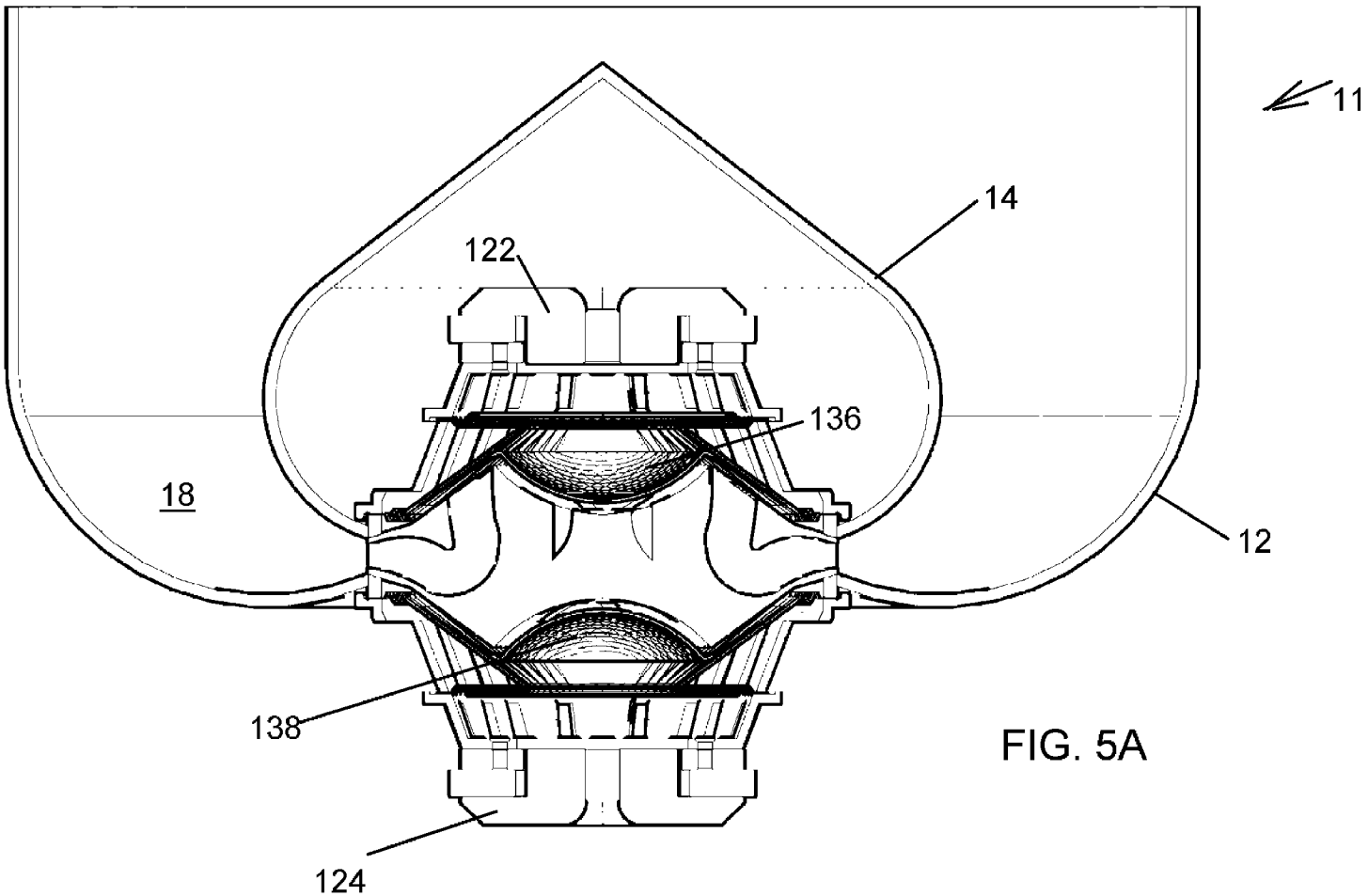
FIG. 5A is a cross sectional view of the radial waveguide assembly incorporating an alternative transducer section.
Figure 5B:
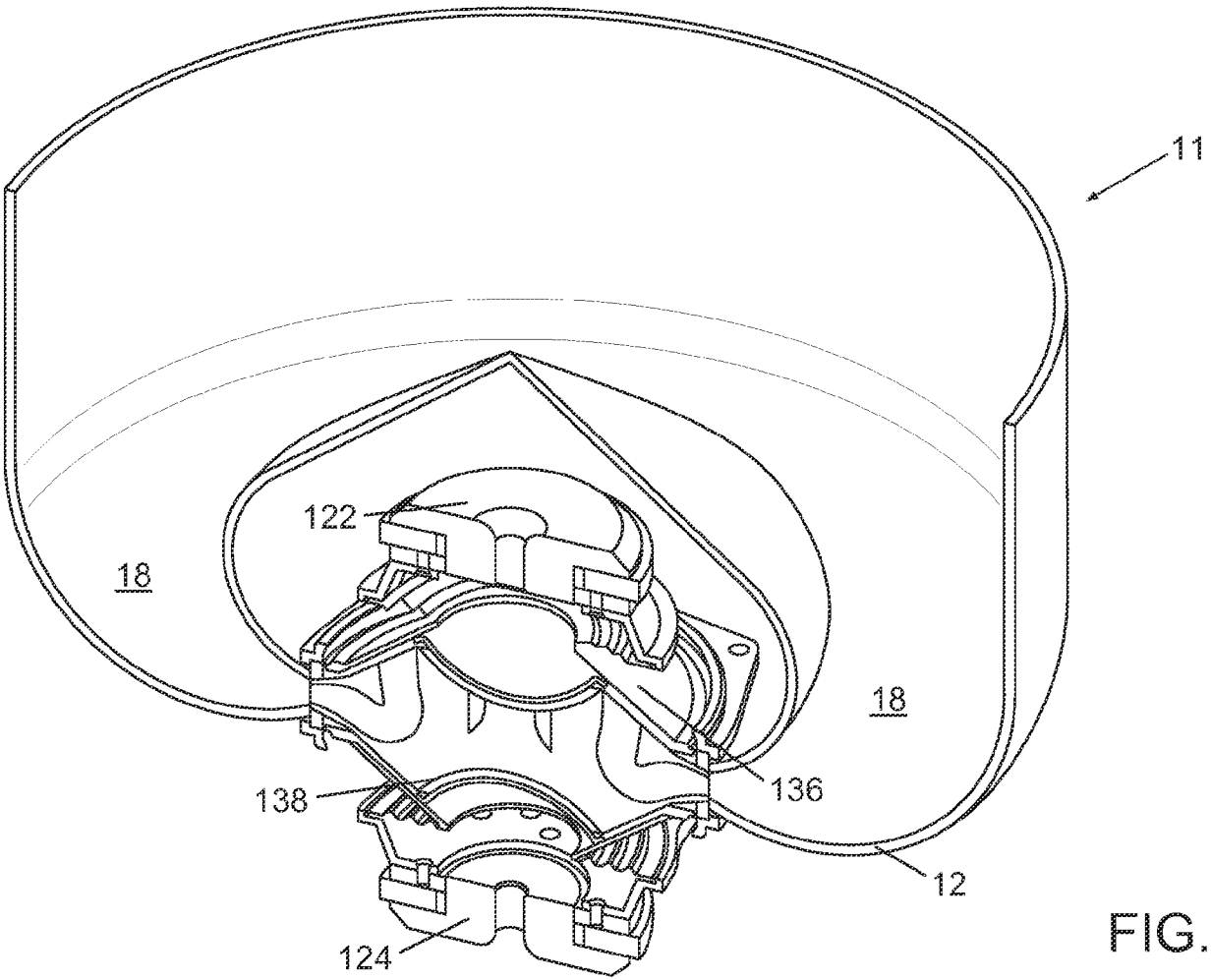
FIG. 5B is a cutaway view of the radial waveguide assembly incorporating the alternative transducer section of FIG. 5A.
Figure 6A:
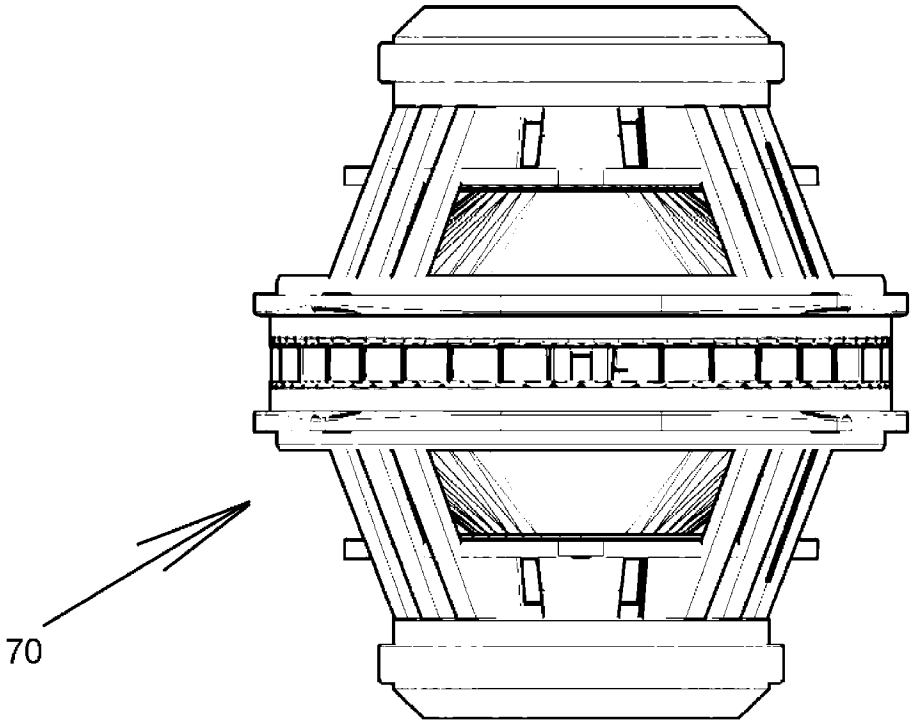
FIG. 6A is a side elevation of the alternative transducer section.
Figure 6B:
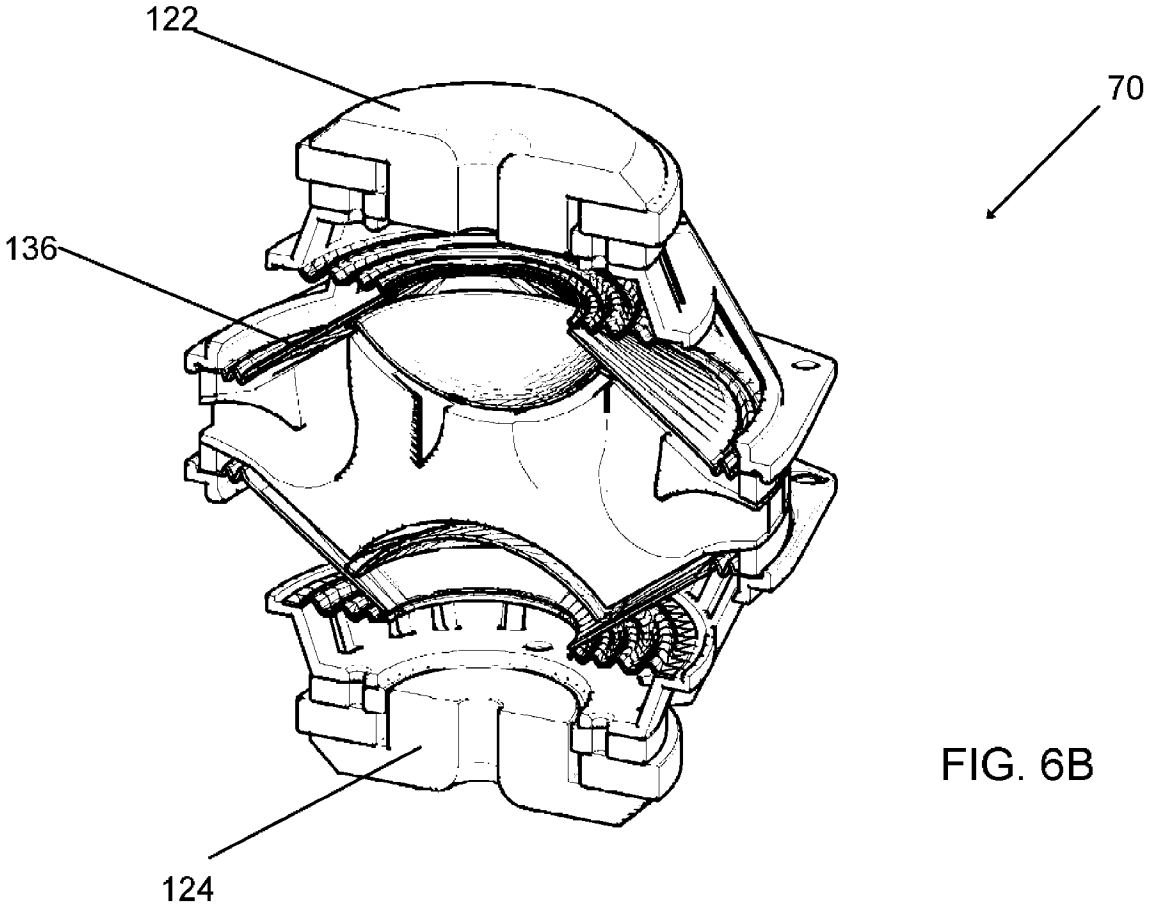
FIG. 6B is a cutaway view in perspective of the alternative transducer section.
Figure 7A:
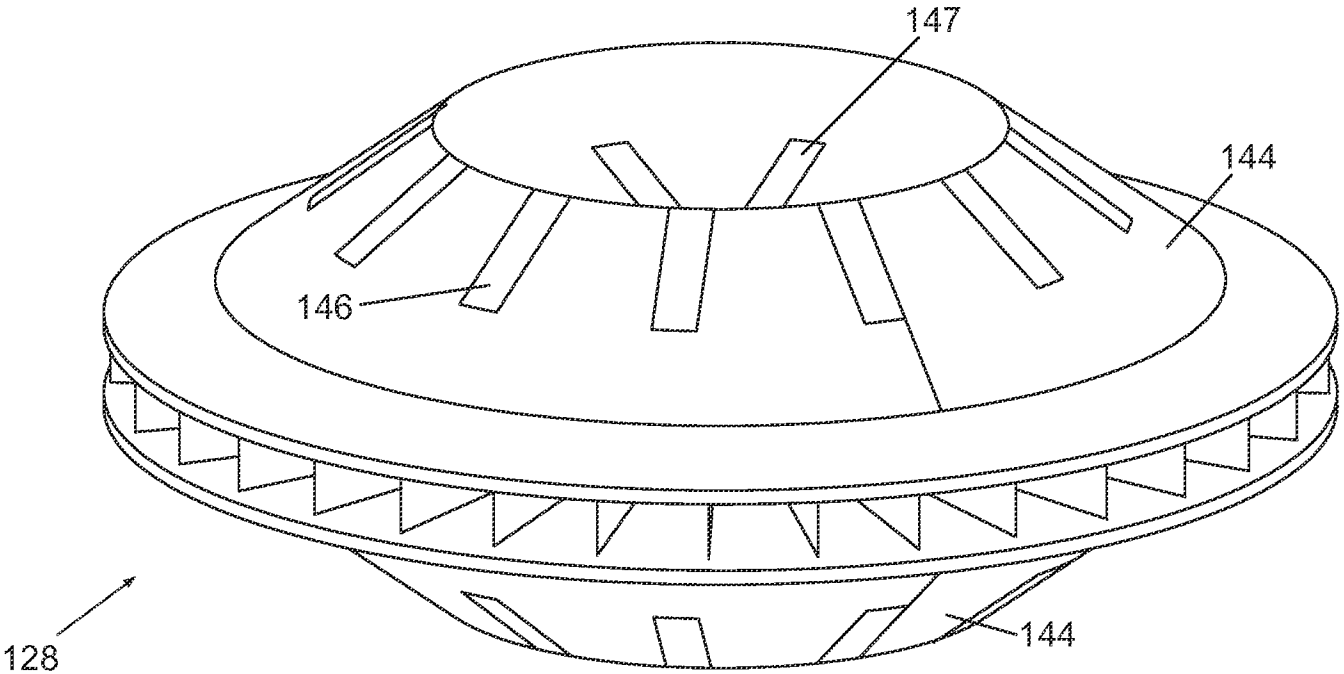
FIG. 7A is a perspective view of a compression plug of the alternative transducer section.
Figure 7B:
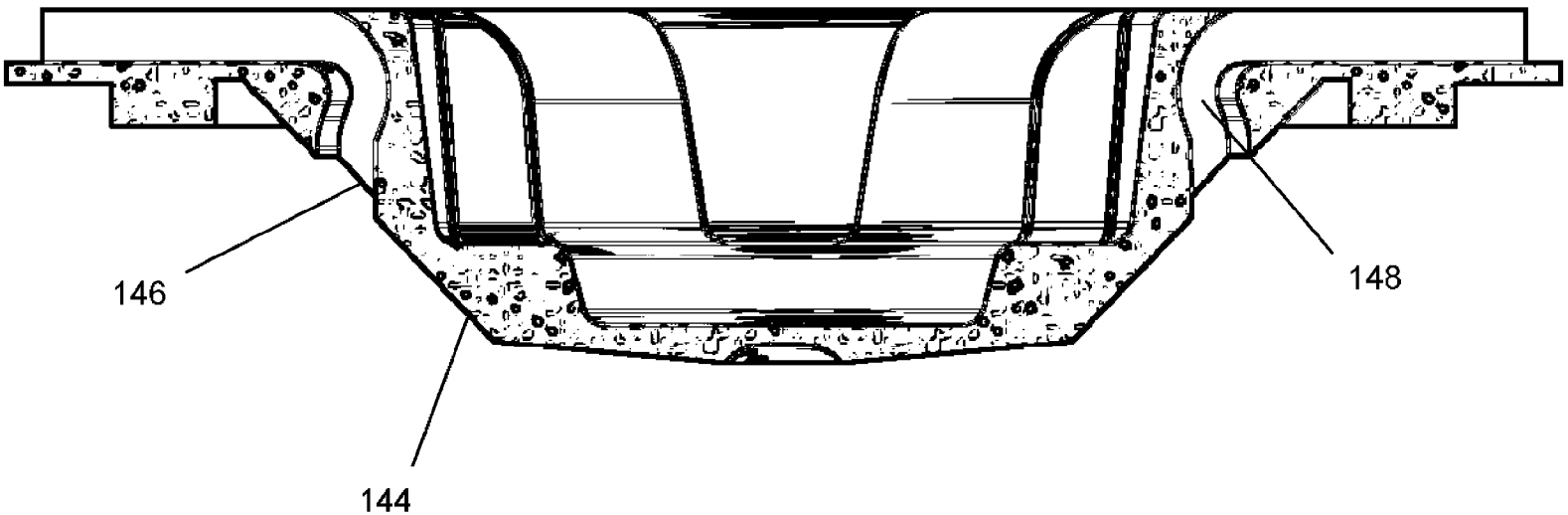
FIG. 7B is a cross section view of half of the compression plug of FIG. 7A.
Figure 7C:
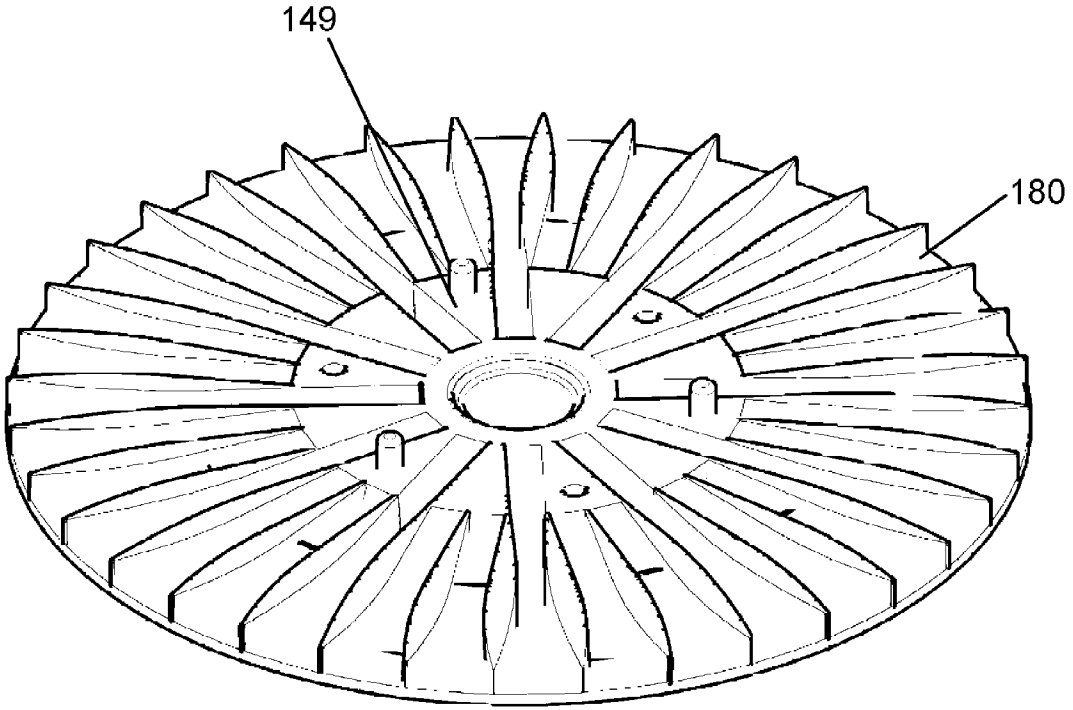
FIG. 7C is a perspective view of an interior face of half the compression plug of the alternative transducer section.
Figure 7D:
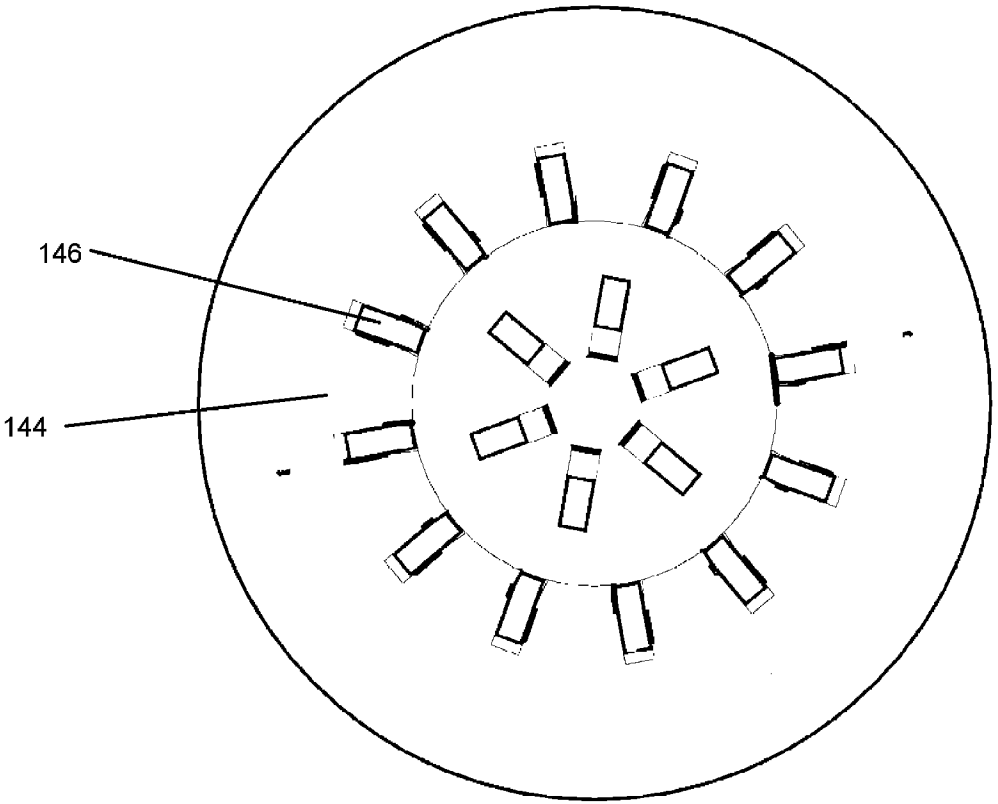
FIG. 7D is a top plan view of an exterior face of the compression plug for the alternative transducer section.

FIG. 1 illustrates a radial waveguide assembly 10. The radiant axis from the device is a line extending perpendicular to the plane of the mouth 34. Referring generally to FIGS. 2-4 a first embodiment of a radial waveguide assembly is illustrated comprising a transducer section 16 and a waveguide section 11. FIGS. 5-7 illustrate an embodiment incorporating an alternative transducer section 70.

The transducer section 16 includes a first or upper cone loudspeaker 22 and a second or lower cone loudspeaker 24. The upper and lower cone loudspeakers 22, 24 are mounted in coaxial opposition, with the diaphragms 36, 38 facing toward one another. A compression plug 28 is disposed between diaphragms 36, 38 and has two input surfaces 44 which are juxtaposed to diaphragms 36, 38. Compression plug 28 is attached to upper and lower cone loudspeakers 22, 24 by assembly rings 52, 54, which provide a framework allowing attachment of the inner and outer forms 14, 12 used to construct the waveguide section 11 and which define the folded radial waveguide 18. An outside lateral circular perimeter to the compression plug extends between assembly rings 52, 54, spacing the rings and allowing communication between outlet ports 42 and an inwardly oriented, circular waveguide throat 32.

Compression plug 28 is roughly disk shaped with two major surfaces, those being input surfaces 44. The input surfaces 44 are conformed to the shape of the diaphragms 36, 38 of the cone loudspeakers 22, 24. Diaphragms 36, 38 operate in phase with one another in contrast with the more usual push-pull, out of phase operational arrangements used in isobaric loudspeaker systems with facing diaphragms. In further contrast to isobaric systems the present system generates acoustic signals in the volume between the diaphragms 36, 38. The outlet ports 42 from the compression plug 28 are arranged in a circular band on a perimeter surface 40 of the compression plug. The outlet ports 42 are at substantially right angles to the inlet ports 46.

Channels 48 through compression plug 28 connect inlet ports 46 on the input surfaces 44 to perimeter outlet ports 42. Each outlet port 42 is fed by two channels 48. One inlet port 46 from each of the two input surfaces 44 feeds outlet port along channels 48 of equal length.

Compression plug 28 is fabricated from two moldings 55 which define an anti-resonant cavity 30 upon assembly.

Inlet ports 46 may be configured as arcs which are centered on the diaphragms 36, 38 upon assembly. These arcs may be differentially spaced relative to the center, but are displaced outwardly away from the central section of the cone diaphragm. A compression plug 60 for use with dome speakers has an input surface 68 including a central spherical section 62 and radially extending input ports 64, 66.

Waveguide section 11 is constructed from inner and outer forms 14, 12. Inner form 14 attaches along its one exposed edge to ring assembly element 52. Inner form 14. Inner form 14 is generally tear drop or kiss shaped with its base open at the center and resting on an edge defining the open base on the ring assembly element 52 adjacent the perimeter 40 of the compression plug 28. The inner form 14 tapers upwardly leaving an inner cavity 20 which encloses the upper transducer 22. The outer form 12 is cup shaped with an opening in the bottom center which fits around lower transducer 24 to attach along the edge defining the open bottom to assembly ring 54 adjacent the perimeter 40 of compression plug 28. The opening defined by the lip of the outer form 12 defines a waveguide mouth 34 through which sound is directed.

Folded radial waveguide 18 has a circular throat 32 which connects the circular perimeter 40 of the compression plug. The contour of the inner form 14 largely determines the rate of expansion of the folded radial waveguide 18 defined by the waveguide assembly 11 if configured to operate as a horn.

FIGS. 5 through 7 illustrate an alternative transducer section 70 with loudspeakers 122, 124 which incorporate diaphragms 136, 138 with central dome sections. A compression plug 128 is positioned between the diaphragms 136, 138 which provides both inner and outer radial inlets 147, 146 on the major input surfaces 144. Again perimeter outlet ports 142 are connected to the inlets by channels through the compression plug 128. These channels are of two types providing for equalizing the distance traveled from the inner radial inlets 147 to perimeter outlet ports 142 and outer radial inlets 146 to the perimeter outlet ports 142. Serpentine channels 148 connect the outer radial inlets 146 to perimeter outlet ports 142. Relatively direct channels 149 provided in a central channel section 180 connect inner radial inlets 147 to perimeter outlet ports 142.

What is claimed is:

1. A loudspeaker system assembly comprises:

at least a first cone loudspeaker having a radiating diaphragm;

a compression plug having a first surface juxtaposed to the radiating diaphragm of the first cone loudspeaker and a perimeter surface encircling the first surface;

outlet ports from the compression plug arranged in a circular band on the perimeter surface;

inlet ports on the first surface;

channels connecting the inlet ports to the outlet ports for coupling acoustic energy generated by the first cone loudspeaker to the outlet ports, the channels bending through substantially ninety degrees so that acoustic energy is radiated outwardly perpendicular to a radiant axis;

a waveguide section; and the waveguide section having a inwardly directed ring throat which is coupled to the outlet ports and a folded waveguide collimating sound energy emitted from the outlet ports along the radiant axis.

2. The loudspeaker system of claim 1, further comprising:

the folded waveguide having inner and outer forms with the outer form being generally cup shaped and the inner form being kiss shaped to enclose a back portion of the first cone loudspeaker and to define the expansion profile of the folded waveguide.

3. The loudspeaker system of claim 2, further comprising:

a second cone loudspeaker arranged coaxially with and opposed to the first cone loudspeaker;

the compression plug having a second surface juxtaposed the second cone loudspeaker;

inlets through the second surface;

channels connecting the inlets through the second surface to the outlet ports for coupling acoustic energy generated by the second cone loudspeaker through substantially a ninety degree turn to the outlet ports; and the first and second surfaces conformed to the shape of diaphragms for the first and second cone loudspeakers.

* * * * *